US009951556B2

(12) United States Patent
Newman, Jr.

(10) Patent No.: US 9,951,556 B2
(45) Date of Patent: Apr. 24, 2018

(54) MOTORIZED ROLLER TUBE SYSTEM HAVING DUAL-MODE OPERATION

(71) Applicant: Lutron Electronics Co., Inc., Coopersburg, PA (US)

(72) Inventor: Robert C. Newman, Jr., Emmaus, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 679 days.

(21) Appl. No.: 13/681,984

(22) Filed: Nov. 20, 2012

(65) Prior Publication Data

US 2013/0112797 A1 May 9, 2013

Related U.S. Application Data

(63) Continuation of application No. 11/096,784, filed on Apr. 1, 2005, now abandoned.

(51) Int. Cl.
*E06B 9/72* (2006.01)

(52) U.S. Cl.
CPC ..... *E06B 9/72* (2013.01); *E06B 2009/725* (2013.01)

(58) Field of Classification Search
CPC ..... E06B 9/72; E06B 2009/725
USPC ..... 160/310, 311; 318/264–266, 272, 275, 318/277, 282, 286, 466–469, 626
See application file for complete search history.

(56) References Cited

U.S. PATENT DOCUMENTS 4,079,597 A * 3/1978 Lindner et al. ..... 192/142 R
4,159,162 A * 6/1979 Christoffel ..... 359/461
4,411,348 A 10/1983 Fillion
4,417,185 A 11/1983 Bullat
4,444,363 A 4/1984 Jacquel et al.
5,044,417 A 9/1991 Bresson
5,203,392 A 4/1993 Shea
5,274,499 A 12/1993 Shopp
(Continued)

FOREIGN PATENT DOCUMENTS

DE 3032031 5/1981
DE 3834643 4/1990
(Continued)

OTHER PUBLICATIONS

Baldor Motion Products, Mar. 2002.*

*Primary Examiner* — Blair M Johnson

(74) *Attorney, Agent, or Firm* — Amy E. Yanek; Glen R. Farbanish

(57) ABSTRACT

A motorized system for reeling and unreeling a flexible member on a roller tube between fully open wound and fully closed unwound conditions to minimize sound pressure level has a rotatable roller tube and a flexible member that winds on the tube. A d-c motor drives the tube through a gear reduction. The motor has a motor speed versus torque characteristic extending linearly from high maximum RPM, low minimum torque, to low minimum RPM high maximum torque with peak efficiency at a given RPM. The motor moves the member between the two positions at a motor speed less than the given peak efficiency RPM and less than 50% of high maximum RPM with efficiency less than 25% of peak efficiency, intentionally at a high torque and low efficiency. The motor has two or more modes each moving the member at predetermined different linear speed.

17 Claims, 7 Drawing Sheets

(56) References Cited

U.S. PATENT DOCUMENTS

| | | | | |
|---|---|---|---|---|
| 5,414,334 | A | | 5/1995 | Cheron |
| 5,429,558 | A | | 7/1995 | Lagarde |
| 5,467,266 | A | | 11/1995 | Jacobs et al. |
| 5,583,404 | A | * | 12/1996 | Karwath et al. ..... 318/400.14 |
| 5,621,295 | A | | 4/1997 | Vanderschaeghe et al. |
| 5,663,621 | A | | 9/1997 | Popat |
| 5,671,387 | A | | 9/1997 | Jacobs et al. |
| 5,711,360 | A | | 1/1998 | Viotte |
| 5,847,525 | A | | 12/1998 | Cheron et al. |
| 5,848,634 | A | | 12/1998 | Will et al. |
| 5,850,131 | A | | 12/1998 | Wolfer et al. |
| 6,082,433 | A | | 7/2000 | Vafaie et al. |
| 6,095,223 | A | * | 8/2000 | Rossini et al. ..... 160/107 |
| 6,100,659 | A | | 8/2000 | Will et al. |
| 6,118,243 | A | | 9/2000 | Reed et al. |
| 6,201,364 | B1 | | 3/2001 | Will et al. |
| 6,379,276 | B1 | * | 4/2002 | Cheng ..... 475/4 |
| 6,497,267 | B1 | | 12/2002 | Azar et al. |
| 6,628,029 | B2 | | 9/2003 | Astegno |
| 6,672,363 | B2 | | 1/2004 | Schmidt |
| 7,129,657 | B2 | | 10/2006 | Cavarec et al. |
| 7,129,662 | B2 | | 10/2006 | D'ayot |
| 2003/0098133 | A1 | | 5/2003 | Palmer |
| 2004/0250964 | A1 | | 12/2004 | Carmen, Jr. et al. |
| 2005/0173080 | A1 | | 8/2005 | Carmen et al. |
| 2005/0215210 | A1 | | 9/2005 | Walker |

FOREIGN PATENT DOCUMENTS

| | | |
|---|---|---|
| DE | 4440449 | 6/1995 |
| DE | 29722936 | 4/1998 |
| EP | 0092118 | 10/1986 |
| EP | 0783072 | 7/1997 |
| EP | 1143101 | 10/2001 |
| EP | 0808986 | 2/2003 |
| EP | 1083291 | 4/2003 |
| EP | 1345307 | 9/2003 |
| WO | 2004/044455 | 5/2004 |

* cited by examiner

MOTORIZED ROLLER TUBE SYSTEM HAVING DUAL-MODE OPERATION

CROSS-REFERENCE TO RELATED APPLICATION

The present application is a continuation under 37 C.F.R. § 1.53(b) of prior U.S. Ser. No. 11/096,784, filed Apr. 1, 2005 in the name of Robert C. Newman, Jr. entitled MOTORIZED ROLLER TUBE SYSTEM HAVING DUAL-MODE OPERATION which is related to co-pending U.S. Ser. No. 11/096,783, filed Apr. 1, 2005 in the names of Jason O. Adams; Thomas W. Brenner; Brandon J. Detmer; Robert C. Newman, Jr.; and Joel Spira entitled DRIVE ASSEMBLY FOR A MOTORIZED ROLLER TUBE SYSTEM the co-pending application is incorporated herein by reference in its entirety.

FIELD OF THE INVENTION

The present invention relates to motorized roller tube systems, used for winding flexible members such as shades, screens and the like, and more particularly to a drive assembly for a motorized roller tube system.

BACKGROUND OF THE INVENTION

Figure 1:
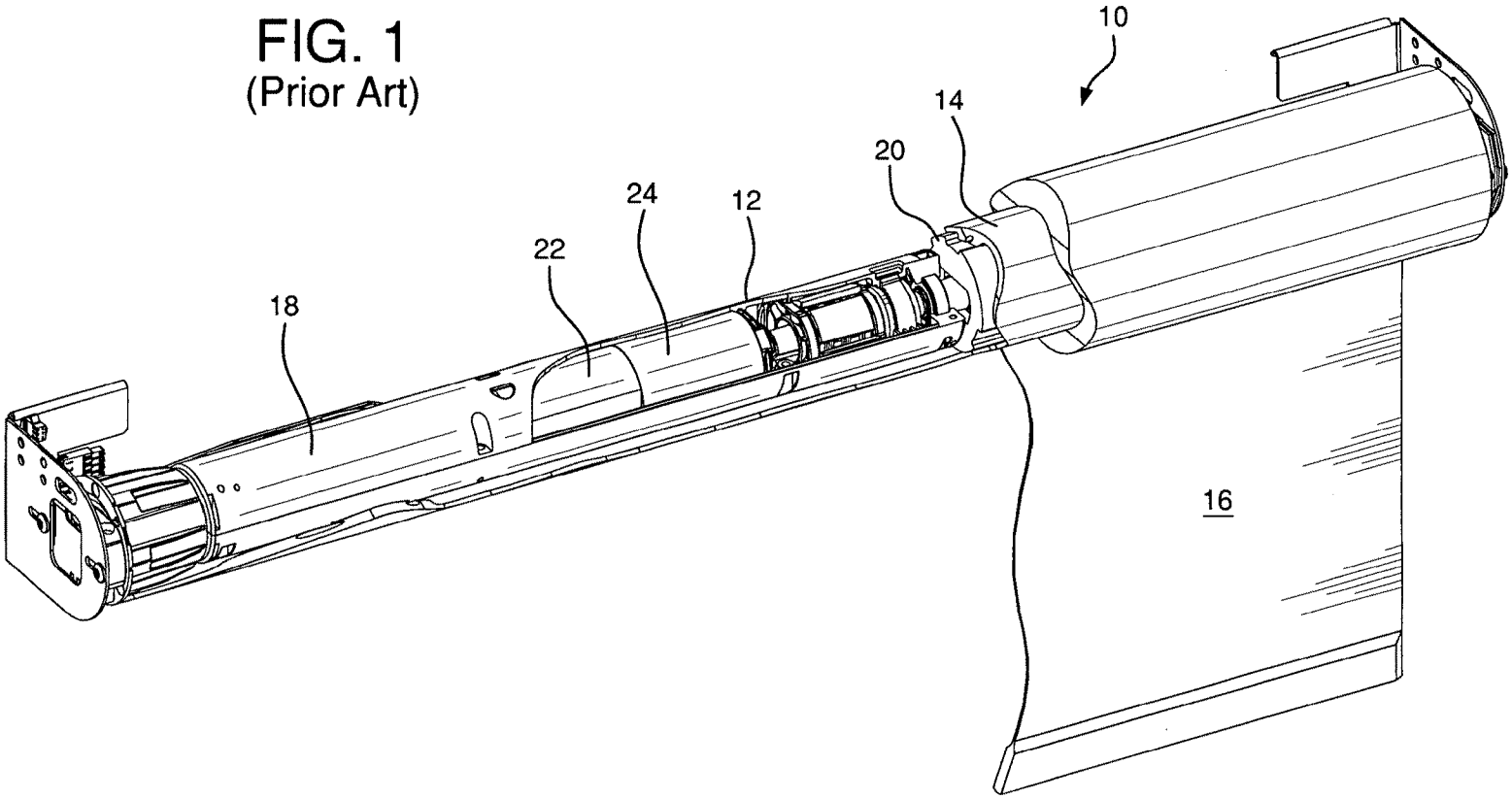
FIG. 1 (Prior Art)
FIG. 1 is a perspective view of a motorized roller tube system including a prior drive assembly.

Referring to FIG. 1, there is shown a motorized roller tube system 10 having a prior drive assembly 12. The motorized roller tube system 10 includes a rotatably supported roller tube 14 and a flexible member 16, such as a window shade fabric, windingly received by the roller tube 14. The flexible member 16 is typically engaged to the roller tube 14 by securing an end portion of the flexible member 16-to the roller tube 14. There are a variety of well-known means for securing the flexible member 16 to the roller tube 14 including, for example, the use of double-sided tape, or by a clip member received over an end portion of the flexible member 16 in a locking channel provided on the exterior of the roller tube 14. The roller tube 14 is driven in opposite rotational directions by the drive assembly 12 for winding and unwinding the flexible member 16 with respect to the roller tube 14. The prior drive assembly 12 includes an elongated housing 18 and a puck 20 located adjacent an end of the housing 18. The puck 20 engages an inner surface of the roller tube 14 to drive the roller tube 14 as the puck is rotated by the drive assembly 12.

Figure 2:
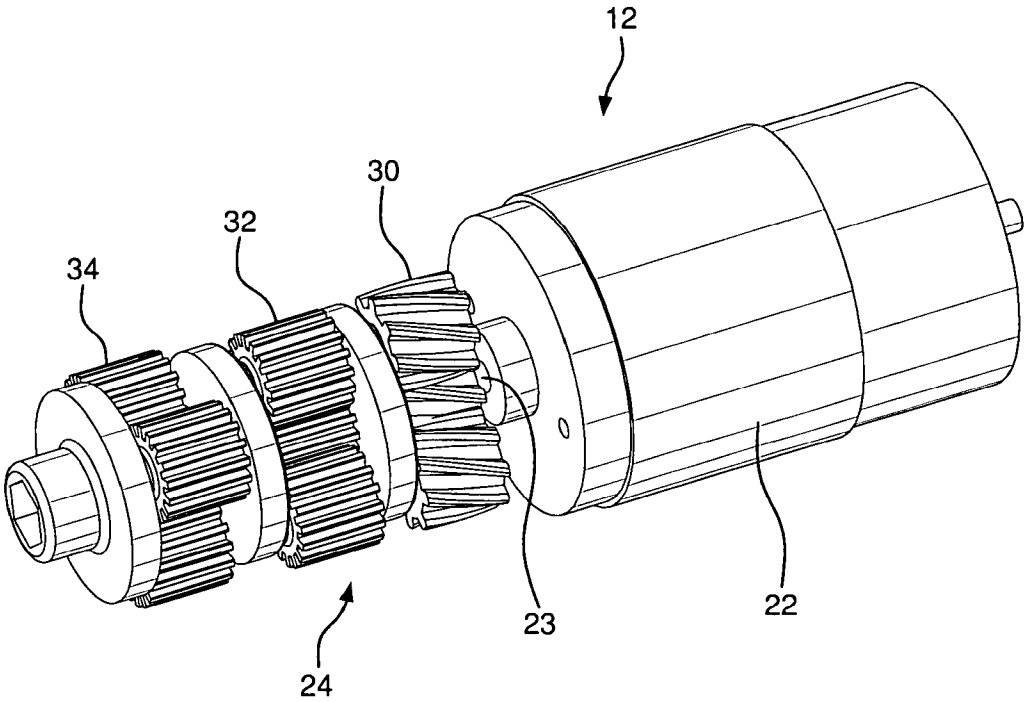
FIG. 2 (Prior Art)
FIG. 2 shows the motor and gear assembly of the prior drive assembly of FIG. 1.

The prior roller tube drive assembly 12 includes a motor 22 and gear assembly 24 located within an interior of the housing 18 and connected to the puck 20. The motor 22 and gear assembly 24 are shown in FIG. 2 removed from housing 18. The motor 22 of prior drive assembly 12 is a DC motor. Referring again to FIG. 1, the drive assembly 12 is received within the interior of the roller tube 14. For this reason, this type of roller tube drive assembly is referred to as an "internal" drive assembly. Other known motorized roller tube systems include drive assemblies that are located externally of the roller tube.

The motor 22 includes an output shaft 23 that is rotated by the motor at a rotational speed referred to herein as the "motor speed". The prior drive assembly 12 operates the motor at a motor speed of approximately 2000 rpm. The gear assembly 24, which is connected to the output shaft of the motor 22, reduces rotational speed from the relatively fast speed of 2000 rpm input from motor 22 to a relatively slow output rotational speed of approximately 27 rpm for roller tube 14. The gear assembly 24 of the prior drive assembly 12, therefore, has a gear ratio of approximately 74:1 (i.e., 2000/27).

Figure 3:
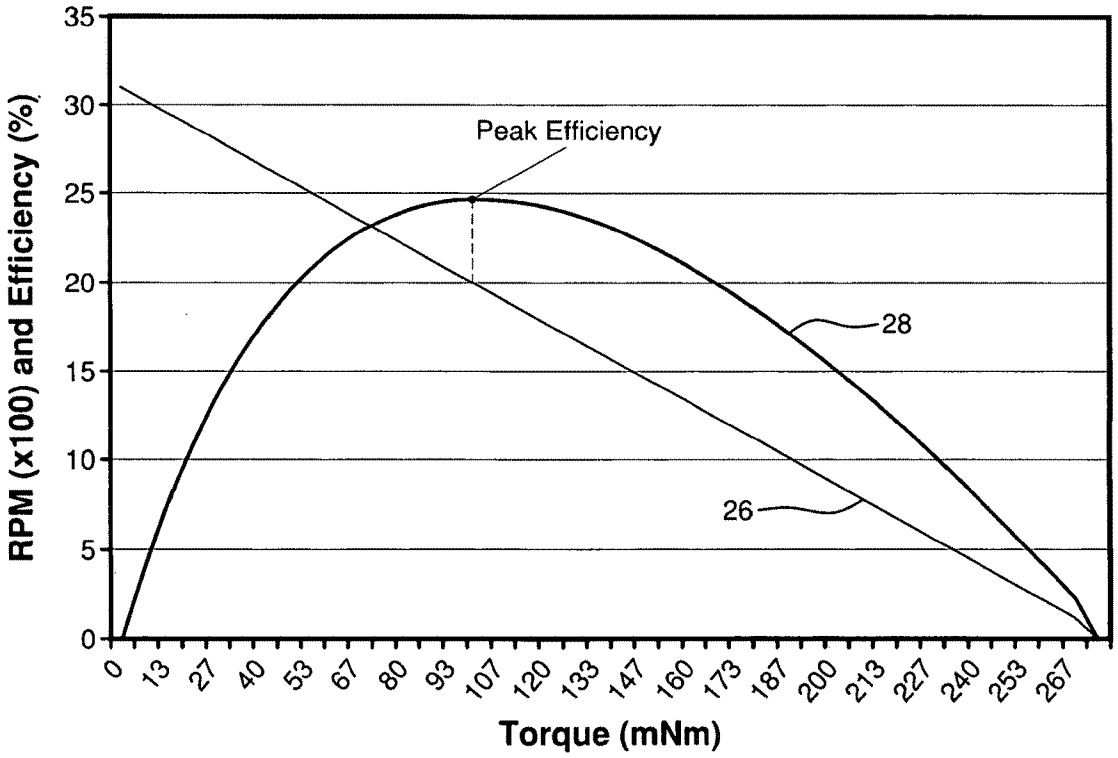
FIG. 3 (Prior Art)
FIG. 3 is a motor curve for the motor of FIG. 2.

The torque capability of a motor varies depending on the motor speed. Therefore, the motor of any motorized roller tube system must provide a torque capability at the operating motor speed that is sufficient to wind the flexible member 16 onto the roller tube 14. Referring to FIG. 3, the performance characteristics for motor 22 of prior drive assembly 12 are shown graphically. Graphs of this type are referred to as "motor curves". The relationship between motor speed (shown on the Y-axis) and motor torque capability (shown on the X-axis) is represented by line 26. As shown, the maximum motor speed for motor 22 is approximately 3150 rpm and the maximum motor torque capability is approximately 280 m-Nm. As also shown, the motor torque capability for DC motor 22 varies linearly throughout the entire range of motor speeds. In other words, the motor will provide increasing torque capability with decreasing motor speed even at very slow speeds approaching zero. It should be understood the motor torque values on speed/torque line 26 of FIG. 3 represent capability rather than fixed values of operating motor torque. In other words, the motor 22 is capable of operating at a given motor speed at any torque between zero (i.e., an unloaded condition) and the value represented on the speed/torque line 26. At the operating speed of 2000 rpm, the torque capability of motor 22 is approximately 99 m-Nm.

As shown in FIG. 3 by curve 28, the efficiency of motor 22 also varies depending on the motor speed. The efficiency, which is shown on the Y-axis with motor speed, is determined by reading vertically from the speed/torque line 26 to the efficiency curve 28. Thus, at the operating motor speed of 2000 rpm, the motor 22 of prior drive assembly 12 has an efficiency of approximately 25 percent. As shown, the motor efficiency of 25 percent is the peak efficiency for motor 22. The motor speed associated with peak efficiency is referred to herein as the peak efficiency motor speed. The peak efficiency motor speed represents approximately 65 percent of the maximum motor speed (i.e., 2000/3100).

Although the particular values of motor speed, torque capability, and efficiency will vary for different DC motors, there are certain characteristics that are shared by all DC motors. Firstly, motor speed and motor torque capability will vary linearly, and inversely, throughout the entire range of motor speeds including very low speeds approaching zero. Secondly, motor efficiency will generally reach peak efficiency under light-duty conditions (i.e., relatively low torque capability at a motor speed greater than 50 percent of maximum motor speed). Prior drive assemblies include motors configured and operated by the drive assembly under light-duty conditions near the peak efficiency motor speed. As described below in greater detail, operation of the motors under such relatively light-duty conditions is in accordance with motor manufacturer recommended operation of the motor.

The gear assemblies of known roller tube drive assemblies include planetary spur gears. Planetary spur gears are desirably economical in construction and provide efficient transmission compared to other types of gears. Spur gears, however, tend to be noisy in operation compared to other gear types because of sound generated as peripheral teeth contact each other. This contact sound associated with meshing teeth is sometimes referred to as "gear slapping" and increases as the rotational speed of the meshing gears is increased. Known gear assemblies also include gear stages having helical gears. Helical gears include elongated spiral flights that constantly engage with flights of other helical gears. The constant engagement of the flights eliminates the slapping noises associated with contact between the teeth of spur gears. Helical gears, however, tend to be less economical and less efficient than spur gears.

The gear assembly 24 of prior drive assembly 12 includes three gear stages 30, 32, 34. The gear assembly 24 is a hybrid gear system and includes a first stage 30 having helical gears and second and third stages 32, 34 each having planetary spur gears. The first gear stage 30 is located closest to the motor 22. The gears of stage 30, therefore, are rotated at the relatively fast motor speed of 2000 rpm. The rotational speed in the second and third stages 32, 34, however, is stepped down from the 2000 rpm motor speed. Thus, the hybrid construction of prior drive assembly 12 represents a trade-off in which quieter, less efficient, more expensive helical gears are used in the relatively fast first stage 30, while efficient, less expensive, but noisier, planetary spur gears are used in the relatively slower second and third stages 32, 34.

Prior motorized roller tube systems include systems providing for variable-speed control of a drive assembly motor. The variable-speed control feature is used in prior systems to provide for movement of the flexible member (known as "linear speed" or "fabric speed") that is substantially constant. The variable motor speed adjusts the tube rotational speed to account for variation in the effective winding radius associated with the formation of winding layers as the flexible member is wound onto the roller tube. If the roller tube were to be rotated at a constant rotational speed, the fabric speed would change as the effective radius changed. Prior motorized roller tube systems control the motor speed to slow down the motor speed as the flexible member is wound onto the roller tube for substantially constant fabric speed. The prior motorized roller tube systems, however, do not provide for multiple modes of operation in which the fabric speed in each mode of operation is different from the fabric speed in the other modes of operation.

SUMMARY OF THE INVENTION

According to the present invention, a motorized roller tube system comprises a rotatably supported roller tube and a flexible member engaging the roller tube for winding receipt of the flexible member by the roller tube. The motorized roller tube system also comprises a motor having an output shaft rotated at a motor speed and a gear assembly connected to the output shaft of the motor such that the gear assembly is driven by the motor. The gear assembly includes a plurality of gear stages adapted to produce an output rotational speed that is reduced with respect to the motor speed.

The motorized roller tube system further comprises a controller connected to the motor for controlling the motor to wind or unwind the flexible member with respect to the roller tube. The controller of the present invention is adapted to provide at least two operating modes each providing for movement of the flexible member at a linear speed. The linear speed of each of the operating modes is different from the linear speed for the other modes.

According to one embodiment, the operating modes include a set-up mode and an ultra low speed mode. The linear speed of the set-up mode is greater than the linear speed of the ultra low speed mode. According to one presently preferred embodiment, the linear speed of the set-up mode is at least 2 times faster than the linear speed of the ultra low speed mode.

According to one embodiment, the motorized roller tube system produces a noise level when operating in the ultra low speed mode that is approximately 3 dBA or more below a noise level produced when the motorized roller tube system is operating in the set-up mode.

According to one embodiment, the controller is responsive to an illuminance level input to the controller to adjust the position of the flexible member in response to the illuminance level input to the controller.

DESCRIPTION OF THE INVENTION

Figure 4:
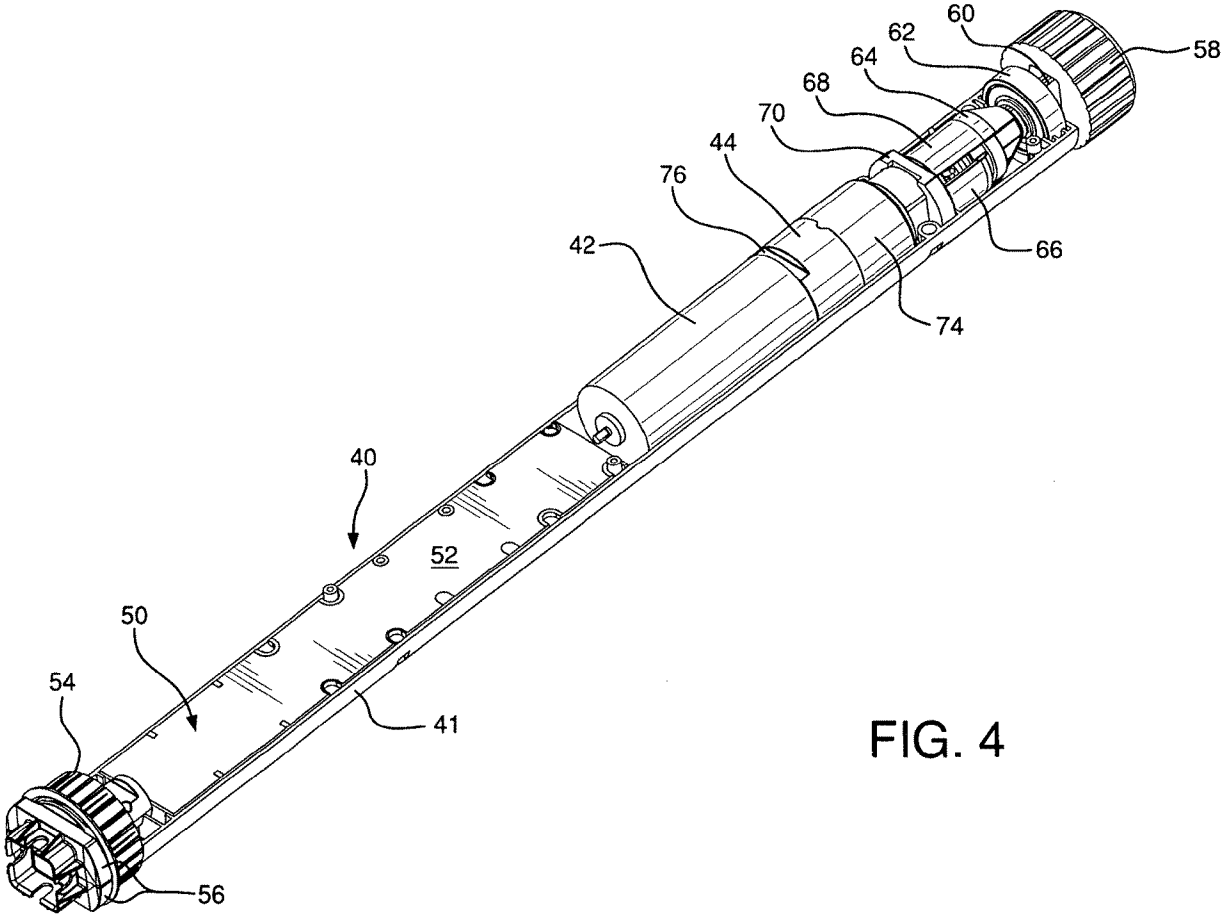
FIG. 4 is a perspective view showing a drive assembly for a motorized roller tube system according to the present invention.
Figure 5:
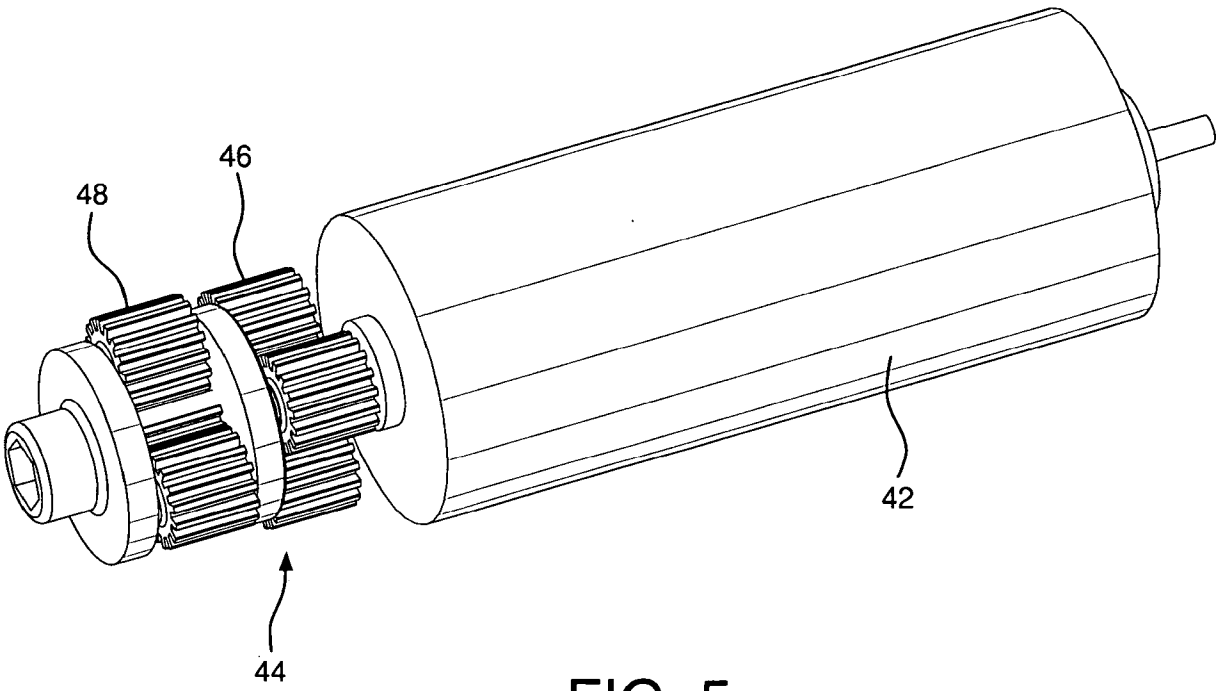
FIG. 5 shows the motor and the gear stages of the gear assembly of FIG. 4 removed from the rest of the drive assembly.
Figure 6:
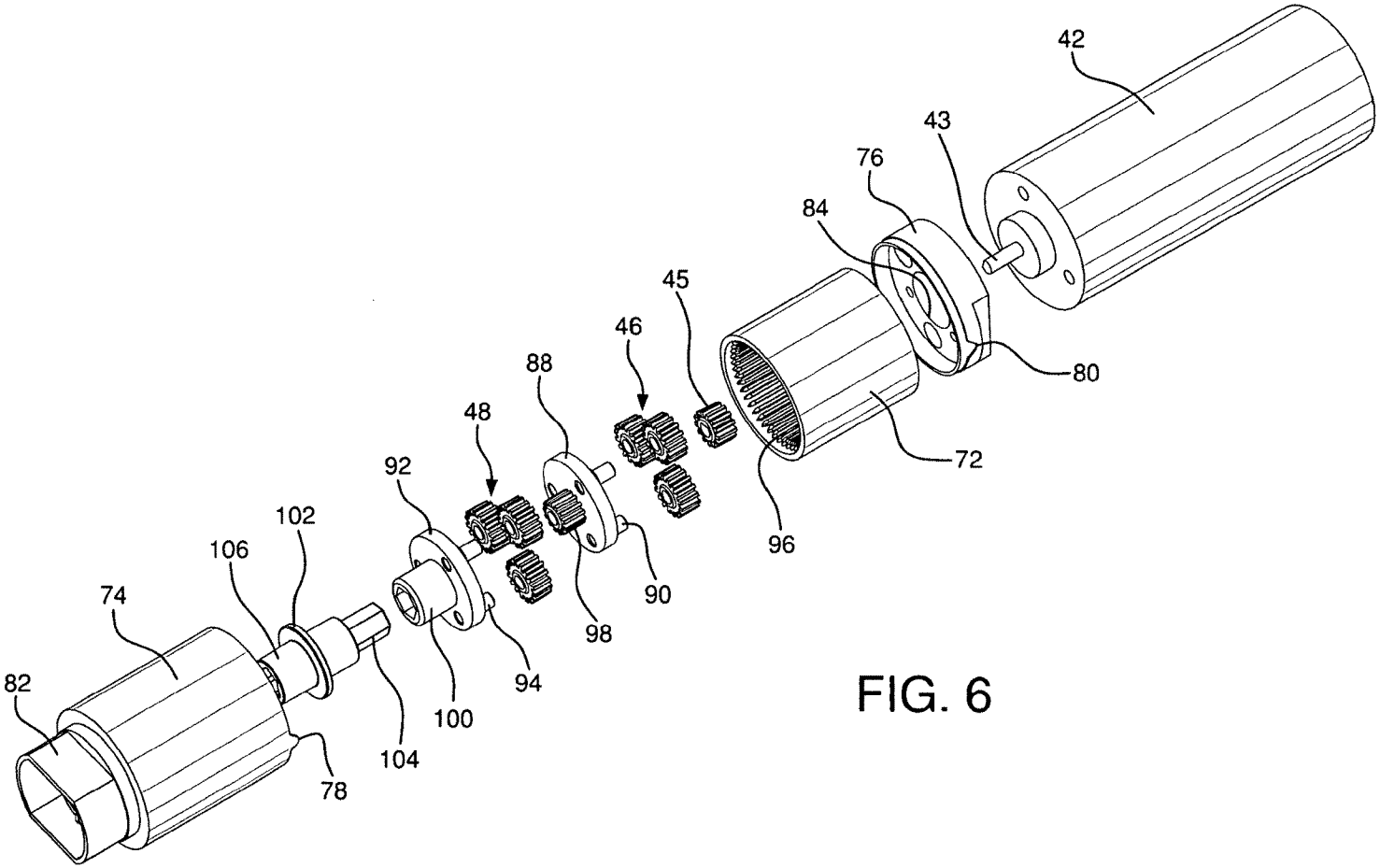
FIG. 6 is an exploded perspective view of the motor and gear assembly of FIG. 4.

Referring to the drawings, where like numerals identify like elements, there is shown in FIGS. 4 through 6 a roller tube drive assembly 40 according to the present invention including a motor 42 and a gear assembly 44 contained within an elongated housing 41. The drive assembly 40 of the present invention is adapted for receipt within a roller tube, such as the tube 14 of FIG. 1, to engage an inner surface of the roller tube for rotating the tube to wind or unwind a flexible member, such as a window shade fabric. The receipt and engagement of the drive assembly 40 is similar to that described above for the prior drive assembly 12. As described below in greater detail, however, the drive assembly 40 of the present invention is configured in a novel manner providing for reduction in roller tube diameter for driving a given applied load or, alternatively, driving a large applied load for a given roller tube diameter. Also, the novel configuration generates limited noise for relatively quiet roller tube movements while desirably utilizing spur gear transmission throughout the gear assembly 44.

The motor 42 of drive assembly 40 is preferably a DC motor. Motor 42 has an output shaft 43 for transmission of mechanical power at a motor speed and torque. DC motors are highly reliable, relatively inexpensive and possess adequate torque capability in sufficiently small sizes for most roller tube applications. DC motors include brushed and brushless DC motors. Brushed and brushless DC motors have similar torque/speed curves. Brushless DC motors, however, have a wound stator surrounding a permanent-magnet rotor, which is an inverse arrangement to that of a brushed DC motor. The construction of the brushless motor eliminates the need for motor brushes, which allow current to flow through the wound rotor in a brushed motor. The stator windings of a brushless DC motor are commutated electronically requiring control electronics to control current flow. Brushed DC motors are presently readily available in large varieties and, therefore, are presently preferred for economic reasons.

The majority of the noise generated by drive assembly 40 is created by motor 42 and by the gears in the gear assembly 44. These noise generating elements are shown in FIG. 5 removed from the rest of the drive assembly 40 to facilitate comparison with the corresponding elements of the prior drive assembly 12 of FIG. 2. The gear assembly 44 of drive assembly 40 includes first and second gear stages 46, 48 for reducing rotational speed from the rotational speed of motor 42 to the rotational speed desired for rotating a roller tube in which the drive assembly 40 is received. The gears in each of the stages 46, 48 of gear assembly 44 are planetary spur gears. As described above, the use of planetary spur gears throughout all stages of the gear assembly 44 is desirable because spur gears are economical and provide efficient gear transmission compared to other types of gears such as the helical gears in the first stage of prior drive assembly 12. The planetary spur gears of gear assembly 44 are preferably made from plastic.

Figure 7:
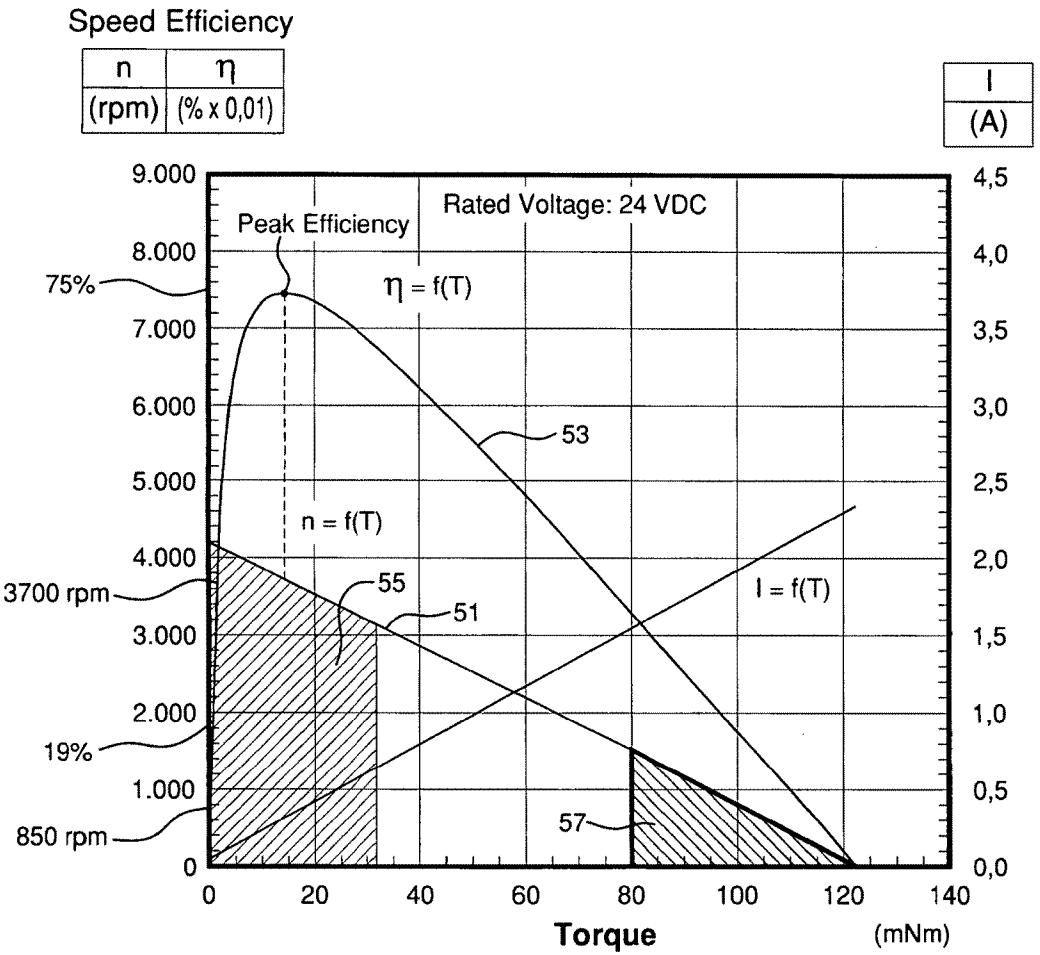
FIG. 7 is a motor curve for the motor of FIGS. 4 and 5.

Referring to FIG. 7, the motor curve for motor 42 is shown. Similar to the motor curve of FIG. 3 for motor 22, FIG. 7 graphically illustrates various performance characteristics for motor 42 including motor speed, motor torque capability and motor efficiency. As shown by line 51, the motor speed and motor torque capability for motor 42, like those of motor 22, are inversely proportional to each other throughout the entire range of motor speeds including very slow speeds approaching zero. The maximum motor speed for motor 42 is approximately 4200 rpm and the maximum motor torque capability is approximately 122 m-Nm. As shown by efficiency curve 53, the motor efficiency for motor 42 reaches a peak of approximately 75 percent when the motor is operated at a speed of approximately 3700 rpm.

The motor curve of FIG. 7 includes a manufacturer's recommended operating range, which is shown by shaded area 55. As shown, the manufacturer's recommended operating range for motor 42 includes motor speeds corresponding to relatively light-duty conditions (i.e., relatively high speeds and relatively low motor torque). Not surprisingly, the manufacturer's recommended operating range includes the peak efficiency motor speed of 3700 rpm. As discussed above, the motors of prior roller tube drive assemblies are operated by the drive assemblies under light-duty conditions in accordance with the manufacturer's recommendations. Specifically, the manufacturer for motor 42 recommends that the motor be operated at motor speeds above approximately 3200 rpm, which represents speed ranging between approximately 76 percent and 100 percent of the maximum motor speed for motor 42, which is 4200 rpm. Also similar to motor 18, the recommended operating range for motor 42 includes the peak efficiency motor speed of 3700 rpm.

Operating the motor of a roller tube drive assembly within the manufacturer's recommended range in conformance with established convention in the art would appear to be intuitively preferred. As discussed above, the recommended operating range includes the peak efficiency motor speed. Therefore, operation of the motor in the recommended range results in efficient operation of the motor. Also, the relatively light-duty conditions (i.e., relatively low torques) associated with the recommended range serves to limit overheating damage that could result from heavy-duty operation of the motor, thereby promoting motor life.

The drive assembly 40, however, is not configured to operate the motor 42 in the manufacturer's recommended range in conformance with established convention. Instead, the motor 42 of drive assembly 40 is preferably operated under heavy-duty conditions (i.e., relatively high torque) in a range of motor speeds represented in FIG. 7 by shaded area 57. As shown, the preferred operating range 57 includes motor speeds between 0 rpm and approximately 1500 rpm. The upper end of 1500 rpm for the preferred operating range represents approximately 36 percent of the maximum motor speed of 4200 rpm for motor 42. Most preferably, the drive assembly 40 operates the motor 42 at a speed of approximately 850 rpm, which represents only approximately 20 percent of the maximum speed. As shown by line 51 of FIG. 7, the motor torque capability for motor 42 when operated at a speed of 850 rpm is approximately 98 m-Nm. As shown by curve 53, the motor efficiency for motor 42 is approximately 19 percent when the motor is operating at the preferred speed of 850 rpm. This motor efficiency represents only approximately one-fourth of the peak efficiency for motor 42 (i.e., 19/75). The drive assembly 40 of the present invention is configured to operate the motor 42 at a motor speed that is well outside the recommended range under conditions that are very inefficient for the motor.

The torque capability of 98 m-Nm provided by motor 42 at its operating motor speed of 850 rpm is roughly equivalent to the 99 m-Nm provided by motor 22 of prior drive assembly 12 at its operating motor speed of 2000 rpm. However, the diameter of motor 22 is 1.65 inches while the diameter of motor 42 is only approximately 1.22 inches. The present invention, therefore, by operating inefficiently outside of the recommended operating range, provides similar torque capability for driving similar applied loads while allowing for reduction in the diameter of the motor. By reducing motor diameter, a corresponding reduction in the required roller tube diameter is provided. Limiting the roller tube diameter is desired aesthetically to avoid an installation that is bulky in appearance. It should be understood that, instead of decreasing motor diameter, the present invention could be used to increase torque capability for a given motor for increasing the applied load that is driven by the motor.

The motor 22 of prior drive assembly 12 has a length of approximately 2.7 inches. The aspect ratio (i.e., length/diameter) of motor 22, therefore, is approximately 1.64 (i.e., 2.7/1.65). This aspect ratio is typical for standard torque motors. Motor 42 of the present drive assembly 40 also has a length of approximately 2.7 inches. The aspect ratio of motor 42, therefore, is approximately 2.21 (i.e., 2.7/1.22). The effect of this increase in the aspect ratio of motor 42 can be seen by comparing FIGS. 2 and 5. It is known that torque capability for a motor varies in proportion to $BID^2L$, where B is magnetic flux, I is current, and D and L are respectively diameter and length of the motor. Thus, the motor torque capability can be increased by increasing any one of B, I, D or L. Because the aspect ratio has been increased from that which is associated with standard torque motors, the motor 42 of the present drive assembly is considered a "high" torque motor. The increased torque capability for motor 42 provided by increased aspect ratio (i.e., increased length) partially offsets the decreased torque capability associated with the decreased diameter. Of course, the reduction in diameter has a much greater impact on torque capability than the increased in length because the diameter is squared in the above relationship (i.e., $BID^2L$). The present invention, therefore, also provides for increase in torque capability by operating the smaller diameter motor under the above-described heavy-duty conditions associated with the preferred range 57.

As described above, the torque capability of 98 m-Nm provided by motor 42 at its operating motor speed of 850 rpm is roughly equivalent to the 99 m-Nm provided by motor 22 of prior drive assembly 12 at its operating motor speed of 2000 rpm. The present invention, however, is not limited to any particular torque capability. Therefore, it is conceivable, therefore, that the drive system could be configured to include a smaller diameter motor having a reduced torque capability compared to motor 42 for use within a smaller diameter roller tube. For example, a motor having a maximum torque capability between 50 m-Nm and 75 m-Nm could be used to drive a roller tube having a diameter less than approximately 1.625 inches.

As discussed above, planetary spur gears are a preferred gear type because of their economy and their gear efficiency but also tend to be undesirably noisy when driven at the relatively high rotational motor speeds associated with prior art drive assemblies. By reducing the motor speed to approximately 850 rpm, however, the present invention desirably allows for the use of spur gears in each stage of the gear assembly 44 without excessive noise being generated in the first stage 46 from gear slapping. As discussed above, the reduction in motor speed to 850 rpm also reduced the gear ratio required by gear assembly 44 to approximately 20:1. As a result, it was possible to reduce the number of gear stages from three to two. Such a reduction in the number of stages provides for a reduction in the total number of gears in the assembly thereby further reducing the noise generated by the gear assembly.

It is desirable that the drive assembly of a motorized roller tube system is capable of variable speed control of the drive assembly motor. Such variable speed control is desirable to account for changes in the effective winding radius for substantially constant movement of a flexible member being wound onto the roller tube. As a flexible member is wound onto a tube, the flexible member forms layers (or "windings") such that the effective radius at which the flexible member is received by, or delivered from, the roller tube changes. Thus, if a roller tube were to be driven at a constant rotational speed, the speed at which the flexible member is moved (sometimes referred to as the "linear speed" or the "fabric speed") would vary because of change in the effective winding radius. It should be understood that rotational speed will need to be reduced as the flexible member is wound onto a tube in order to maintain a constant fabric speed and, therefore, that the rotational speed will be greatest when the roller tube is being driven at or near the point at which the flexible member is fully unwound from the roller tube (i.e., a "fully-lowered" or "fully-closed" position). Also, the least amount of material is wound onto the tube when the flexible member is at the fully-lowered position of the flexible member such that the flexible member provides the least amount of sound attenuation for the roller tube in this position. The sound level produced by the motorized roller tube system, therefore, is greatest when the drive assembly is driving the roller tube at or near the fully-lowered position of the flexible member.

The present invention provides a drive assembly 40 that desirably includes spur gears in each stage of its gear assembly 44 while also limiting noise that is generated by the drive assembly. A motorized roller tube system including the drive assembly 40 housed within a 1.625 inch diameter roller tube was used to drive a typical applied load of approximately 8.1 in-lb (i.e., a 10 pound flexible member applied at 0.81 inch radius). Sound levels generated by the motorized roller tube system were measured using a sound pressure meter at a distance of approximately 3 feet from the driven end of the roller tube. The sound pressure level produced by the motorized roller tube system in an ambient of approximately 38 dBA when the drive assembly 40 is driving the roller tube at or near the fully-lowered position of the flexible member (i.e., the maximum sound level produced by the motorized shade assembly) is approximately 43 dBA. An ambient level of 38 dBA is a sound pressure level in a relatively quiet office setting such as a private office with the door closed, for example. A sound pressure level of between approximately 40-44 dBA generated by a motorized roller tube system in such a setting is considered non-distracting and even pleasant. The sound level generated by the present drive assembly having spur gears driven at rotational speeds well below the speeds associated with the motor manufacturer's recommended operating range compares favorably with that of prior motorized roller tube systems having spur gears driven at the faster rotational speeds recommended for the motor. Such motorized roller tube systems include systems generating sound pressure levels exceeding 50 dBA at approximately 3 feet in an ambient of approximately 38 dBA. Sound pressure levels exceeding 50 dBA in such an ambient environment are considered distracting and even annoying.

The above-described gear assembly 44 includes two gear stages 46, 48. The number of gear stages, however, is not critical. A drive assembly according to the present invention, therefore, could include more than the two stages that are shown in the above-described embodiment. As discussed above, however, reducing the number of gear stages desirably provides for reduction in the total number of gears in the gear assembly and, accordingly, a reduction in gear slapping noise.

As discussed above, inefficient operation of the motor 42 by drive assembly 40 under heavy-duty conditions is counter-intuitive. In addition to inefficient operation of the motor, sustained operation of a motor under the heavy-duty torque conditions associated with the preferred operation range 57 could overheat the motor potentially causing life-shortening damage of the motor. The motors of motorized roller tube systems, however, are not ordinarily operated in a continuous fashion. In a typical motorized roller tube system, such as a window shade for example, the shade fabric might be raised in the morning, lowered at night, and possibly adjusted to a number of other positions at infrequent intervals during the day. Therefore, except in the most unusual situations, the inefficient operation of drive motor 42 will not appreciably effect the motor in terms of longevity. To protect the motor 42, however, it is conceived that the drive assembly 40 could be configured to track the run time of motor 42. The motor 42 could then be disabled in the event that excessive run time has occurred during a given period of time that could adversely affect the motor if the motor were otherwise permitted to continue running. Alternatively, the condition of the motor could be monitored based on the temperature of the motor or related components, or the temperature of surrounding areas, using thermal-couples, thermistors, temperature sensors, or other suitable sensing devices.

Referring again to FIG. 4, some additional details of the construction of drive assembly 40 will now be discussed. The elongated housing 41 is tubular defining an interior in which the drive motor 42 and gear assembly 44 are housed. The drive assembly 40 preferably includes an electronic drive unit ("EDU") 50 for controlling the operation of the drive motor 42. The EDU controller 50 includes a printed circuit board 52 for mounting control circuitry (not shown) of the controller 50. The controller 50 could be configured to track run time of the motor 42 in the above-described manner and to disable the operation of motor 42 in the event that overuse of the motor 42 within a given period of time could damage the motor 42. The EDU controller 50 includes a bearing sleeve 54 and bearing mandrels 56 adjacent an end of the housing 41. Electronic drive units for motorized roller tube systems are known and no further description is necessary.

The drive assembly 40 includes a drive puck 58 located adjacent an end of the housing 41 opposite the EDU bearing sleeve 54 and mandrels 56. The drive puck 58 is connected to a puck shaft 60 that is rotatably supported with respect to the housing 41 of drive assembly 40 by a drive bearing 62. The puck shaft 60 is connected to the gear assembly 44 of drive assembly 40 such that actuation of the drive motor 42 drivingly rotates the drive puck 58. The drive puck 58 includes longitudinal grooves in an outer periphery to promote engagement between the outer surface of the puck 58 and an inner surface of a roller tube when the drive assembly is received within a roller tube. The drive assembly 40 is adapted for receipt within the interior of a roller tube such that the EDU bearing sleeve 54 and mandrels 56 are located adjacent an end of the roller tube. The drive assembly 40 also includes brake 64 having a brake input 66, a brake output 68 and a brake mandrel 70. The brake 64 defines an interior in which the puck shaft 60 is received. The brake 64 is adapted to engage the puck shaft 60 to prevent relative rotation between the motor 42 and the drive puck 58. The engagement of the brake 64 prevents a flexible member from unwinding because of load applied to a roller tube by an unwound portion of the flexible member and any hem bar carried by the member, thereby holding the flexible member in a selected position. Brakes for roller tube drive assemblies are known and no further description is necessary.

Referring to FIG. 6, an embodiment of the motor 42 and gear assembly 44 of drive assembly 40 is shown in greater detail. The gear assembly 44 includes a ring gear 72 received within an interior of a ring gear cover 74. A motor adapter 76 is located between the motor 42 and the ring gear cover 74 and engages an end of the ring gear cover 74. The ring gear cover 74 includes a tab 78 received by a correspondingly shaped notch 80 of the motor adapter 76 to limit relative rotation therebetween. The ring gear cover 74 also includes an end fitting 82 received by the brake mandrel 70.

The gear assembly 44 includes a sun gear 45 that is attached to the output shaft 43 of motor 42 such that the sun gear 45 rotates with the output shaft 43. Preferably, the sun gear 45 is pressed onto the output shaft 43. Each of the first and second stages 46, 48 of gear assembly 44 includes three planetary spur gears that meshingly engage longitudinal teeth 96 formed on an inner surface of the ring gear 72. The sun gear 45 meshingly engages the spur gears of the first stage 46 such that the spur gears of the first stage 46 are rotated by the sun gear 45 at the motor speed. The spur gears of the first stage 46 are rotatingly received on pins 90 of a sun carrier 88. The spur gears of the second stage 48 are rotatingly received on pins 94 of a hex carrier 92. A sun gear 98 is fixed to the sun carrier 88 opposite the pins 90 and meshingly engages the spur gears of the second stage 48 to rotate the second stage gears as the sun carrier 88 is driven by the first stage 46. A hex socket 100 is fixed to the hex carrier 92 opposite the pins 94. The gear assembly 44 also includes a second stage adapter 102 including a hex head 104 received by the hex socket 100 of the hex carrier 92 and a socket 106 opposite the hex head 104 receiving an end of the drive puck shaft 60. The second stage adapter 102 transfers rotation from the hex carrier 92 to the drive puck 58 as the hex carrier 92 is driven by the second stage 48.

The controller 50 of drive assembly 40 preferably provides variable-speed control of the motor speed of motor 42. Such variable-speed control is desirable in a roller tube drive assembly for speed adjustments to account for winding of the flexible member onto the roller tube such that the movement of the flexible member (referred to as "linear speed" or "fabric speed") is substantially constant. An example of such a control system is disclosed in U.S. patent application Ser. No. 10/774,919, filed Feb. 9, 2004, entitled "Control System for Uniform Movement of Multiple Roller Shades", which is incorporated herein by reference in its entirety. As the flexible member is wound onto the roller tube, the material of the flexible member is formed into layers (or "windings"). The layering of the fabric changes the radius at which the fabric is received by, or delivered from, the roller tube. Thus, if the roller tube is driven at a constant rotational speed, the speed of the flexible member will tend to increase as the member is being wound onto the roller tube. It is known to control motor speed for a DC motor by controlling the voltage to the motor using pulse-width modulation. An example of a motorized roller tube system using pulse-width modulation for variable motor speed is disclosed in U.S. Pat. No. 5,848,634, which is incorporated herein by reference.

The motor 42 of the above-described drive assembly is a DC motor, preferably a brushed DC motor. There may be applications, particularly when the applied load to be driven by the motor is relatively large, where an AC induction motor may be preferred over a DC motor. Such a situation could arise, for example, where a single motor is driving multiple roller tubes arranged in end-to-end fashion. For variable-speed control using an AC induction motor, the frequency and the applied voltage to the motor are modulated instead of just the voltage. An AC induction motor is typically wound with a set of stator windings, each driven with an AC voltage waveform. Typically, there are three separate windings spaced about the periphery of the motor stator to be driven by three phases of an AC voltage waveform. The phase displacements of the drive voltage waveforms sets up a rotating field in the rotor section of the motor. The reaction between the induced fields in the rotor and the fields in the stator creates a net torque on the rotor. The speed at which the rotor turns is related to the frequency of the drive waveform and the number of electrical poles created by the winding structure of stator. This relationship is stated in the following equation: $n=120\times FIP$, where n is the rotor speed in rpm, F is drive voltage frequency in Hertz, and P is the number of electrical poles.

Commercially available AC induction motors typically include 2 or 4 poles. This configuration facilitates manufacture of stator windings. AC induction motors having 2 poles and 4 poles will typically run at nominal speeds of 3600 rpm and 1800 rpm, respectively, when driven with a 60 Hz drive voltage waveform. To operate these type of motors at speeds of about 750 to 900 rpm, a reduction pf operating frequency is required. This is accomplished with a frequency controlled inverter circuit. By way of example, a 4 pole AC induction motor will need to be operated with a drive frequency of about 25 Hz to run at a rotor speed of about 750 rpm.

As described above, the drive assembly 40 of the present invention is adapted for receipt within a rotatably supported roller tube, such as the roller tube 14 depicted in FIG. 1. It should be understood, however, that the present invention is not limited to use within cylindrical tubes. The rotatably supported tube, therefore, could be any elongated member capable of being rotatably supported and adapted for winding receipt of a flexible member. Therefore, the roller tube could have a non-circular cross section such as hexagonal or octagonal for example. The non-circular cross section could also conceivably be a non-symmetrical shape such as an oval for example.

The flexible members wound by a roller tube system incorporating the drive assembly of the present invention may include shades, screens, curtains or the like that blocks or reflects, or partially blocks or reflects, light. The flexible member may be formed of paper, cloth, or fabrics of any sort. Examples of flexible members include window shades, window screens, screens for projectors including television projectors, curtains that block or partially block entry of light or that reflect light, and curtains used for concealing or protecting objects.

Operation of the motor 42 at various speeds by the controller 50 allows for additional features. Running the motor at a nominal speed of approximately 1000 rpm allows for very quiet operation and when commanded to move by the operation of a user interface control, such as a wall control station, the movement of the flexible member is considered to be visually responsive to command inputs such as a raise or a lower command. That is to say, that upon the pressing of a raise button, the flexible member moves at an adequate speed to give visual feedback to the user to acknowledge the action being requested. It has been found that a speed of about 3 inches per second for the flexible member satisfies the feedback requirement of human operators. However, when a command is given to move the flexible member to a particular predetermined position, the requirement of visual feedback is greatly diminished. The operator knows that the flexible member, upon being commanded to travel to a predetermined position, requires no additional input from the user. That is, once commanded, the flexible member will be moved to the predetermined position without requiring the user to hold the button that commanded the action. The user is, therefore, inclined to press the button and then proceed to some other activity. This mode of operation affords additional benefits. Since the need for visual feedback of the movement of the flexible member is not required for preset operation, the motor can be caused to run very slowly such that flexible member is moved at a very slow linear speed (herein referred to as "ultra-low speed operation").

There are at least two significant advantages provided by an ultra low speed operation. First during this mode of operation, the noise generated by the motorized roller tube system is further reduced below the approximate 43 dBA level to approximately 40 dBA. In many ambient conditions, a sound level of 40 dBA is undetectable by humans. Second, the ultra low speed of the motor 42 can be selected such that the movement of the flexible member is on the order of about 1 inch per second. This corresponds to a motor speed of about 300 rpm. At this speed, the movement of the flexible member is barely noticeable by room occupants, thus creating less of a distraction to activities being carried out in the room. A motorized roller tube system of this type lends itself to the use of automatic controls such as photo cell sensors.

Conventional lighting systems include systems in which an artificial light source may supplement natural light, such as those including controllable fluorescent lamps located adjacent a window. It is common to provide a control system that measures the total light in the space and adjusts the output of the controllable fluorescent lamps to maintain the room ambient light level at a predetermined value. The ability to control a motorized roller tube system for adjustment of the natural light entering the space, however, has been limited to open loop control, whereby a flexible shade member of the roller tube system is moved in response to manual control, or using a time clock control, or by measuring outdoor illuminance level using a sensor. Previous attempts to measure actual indoor illuminance level for adjustment of a flexible shade member in response results in movement of the flexible shade member that is either too fast or too slow, thereby allowing either too much or too little light into the space. This results in an under-damped oscillating control loop system. Additionally, overly rapid movement of the shades would be annoying to the occupants. The ultra low speed operation of the present invention, and the associated very slow movement of a flexible member, allows for matching between the slow movement of the flexible member with the desired response rate of the indoor illuminance level, thereby preventing the control system from oscillating and causing annoyance to occupants of the lighted space.

The present invention provides a motorized roller tube system having at least two distinct operating modes. In the first mode, the motor of the roller tube system is driven at an operating motor speed of approximately 1000 rpm such that the associated flexible member is moved at a linear speed of about 3 inches per second. The first mode is useful for movement of the flexible member to a selected position in which the operator uses and holds a raise/lower type command to move the flexible member to move to the desired position. The first mode of operation will herein be referred to as "the set-up mode".

In a second mode of operation, the motor of the roller tube system is driven at a speed of approximately 300 rpm such that the associated flexible member is moved at a speed of about 1 inch per second. The second mode of operation is referred to herein as "the ultra low speed mode". The second mode of operation is particularly useful for moving the flexible member to a predetermined position (sometimes referred to as a "preset") or for regulating the contribution of natural light into a room during operation in a closed loop control system as described above.

The foregoing describes the invention in terms of embodiments foreseen by the inventor for which an enabling description was available, notwithstanding that insubstantial modifications of the invention, not presently foreseen, may nonetheless represent equivalents thereto.

In the appended claims, the term "flexible member" should be interpreted broadly as including any member capable of being wound that blocks or reflects, or partially blocks or reflects, light. Non-limiting examples of flexible members include shades, screens and curtains.

What is claimed is:

1. A motorized roller tube system comprising:

a rotatably supported roller tube;

a flexible member engaging the roller tube for winding receipt of the flexible member by the roller tube;

a DC motor having an output shaft rotated at a motor speed, the DC motor having a low efficiency, high torque region of operation and a high efficiency, low torque region of operation defining a peak efficiency;

a gear assembly connected to the output shaft of the motor such that the gear assembly is driven by the motor, the gear assembly including a plurality of gear stages adapted to produce an output rotational speed that is reduced with respect to the motor speed; and a controller connected to the motor for controlling the motor to wind or unwind the flexible member with respect to the roller tube, the controller being configured to control the motor in at least two operating modes comprising a first mode and a second mode, each providing for movement of the flexible member at a predetermined linear speed, and wherein the linear speed for each one of the operating modes is different from the linear speeds for the other modes, the linear speed being greater in the first mode than in the second mode;

wherein the controller is configured to operate the motor when the motor is energized to rotate always at an operating speed that is less than 50 percent of a maximum motor speed of which the motor is capable when the motor operates in the second mode and at an efficiency less than 25% of the peak efficiency.

2. The motorized roller tube system according to claim 1, wherein the first operating mode comprises a set-up mode and the second operating mode comprises an ultra low speed ultra-low-speed mode; and wherein in the ultra-low-speed mode the motor rotates at an operating speed that is always less than 50 percent of the maximum motor speed of which the motor is capable.

3. The motorized roller tube system according to claim 2, wherein the linear speed of the set-up mode is at least two times faster than the linear speed of the ultra-low-speed mode.

4. The motorized roller tube system according to claim 2, wherein the motorized roller tube system produces a noise level when operating in each of the at least two operating modes, and wherein the noise level produced when the system is operating in the ultra-low-speed mode is approximately 3 dBA or more below the noise level produced when the system is operating in the set-up mode.

5. The motorized roller tube system according to claim 1, wherein the controller is responsive to an illuminance level input to the controller to adjust the position of the flexible member.

6. The motorized roller tube system according to claim 5, wherein the linear speed is approximately one inch per second or less when the motor rotates at the operating speed that is less than 50 percent of the maximum motor speed of which the motor is capable.

7. The motorized roller tube system according to claim 2, wherein the motorized roller tube system produces a sound pressure level when operating in the ultra-low-speed mode of operation between 38 dBA and 40 dBA at a distance of approximately three feet from the roller tube in an ambient sound pressure level of approximately 38 dBA.

8. The motorized roller tube system according to claim 1, wherein the controller is responsive to a plurality of control signals including a control signal associated with each of the at least two operating modes.

9. The motorized roller tube system according to claim 8, wherein the controller is responsive to a set-up mode control signal and an ultra-low-speed mode control signal, and wherein the controller controls the motor in response to each of the control signals to move the flexible member at a predetermined linear speed, the set-up mode linear speed being at least two times greater than the ultra-low-speed mode linear speed.

10. The motorized roller tube system according to claim 1, wherein the motor has a motor torque that is always greater than 50 percent of a maximum torque capability of the motor when the motor rotates at the operating speed that is less than 50 percent of the maximum motor speed of which the motor is capable.

11. The motorized roller tube system according to claim 1, wherein the motor rotates in the second mode at an operating speed that is always less than or equal to approximately one-fourth of the maximum motor speed of which the motor is capable.

12. The motorized roller tube system according to claim 2, wherein the operating speed of the motor in the set-up mode is approximately 1000 rpm, and the operating speed of the motor in the ultra-low-speed mode is approximately 300 rpm.

13. A motorized roller tube system comprising:

a rotatably supported roller tube;

a flexible member engaging the roller tube for winding receipt of the flexible member by the roller tube;

a DC motor having an output shaft rotated at a motor speed, the DC motor having a low efficiency, high torque region of operation and a high efficiency, low torque region of operation defining a peak efficiency;

a gear assembly connected to the output shaft of the motor and to the roller tube such that the gear assembly is driven by the motor and the roller tube is driven by the gear assembly, the gear assembly producing an output rotational speed that is reduced with respect to the motor speed; and a controller connected to the motor and configured to control said motor to provide for movement of the flexible member during winding or unwinding of the flexible member at a substantially constant linear speed, the controller responsive to a first control signal to control the motor in a first mode such that the flexible member moves at a first predetermined linear speed, the controller responsive to a second control signal to control the motor in a second mode such that the flexible member moves at a second predetermined linear speed, the first predetermined linear speed at least two times greater than the second predetermined linear speed;

wherein the controller is configured to operate the motor when the motor is energized to move the flexible member at the second predetermined linear speed to rotate always at an operating speed that is less than 50 percent of a maximum motor speed of which the motor is capable when the flexible member moves at the second predetermined linear speed and at an efficiency less than 25% of the peak efficiency.

14. The motorized roller tube system according to claim 13, wherein the motorized roller tube system produces a sound pressure level between 38 dBA and 40 dBA at a distance of approximately three feet from the roller tube in an ambient sound pressure level of approximately 38 dBA when the flexible member moves at the second predetermined linear speed.

15. The motorized roller tube system according to claim 14, wherein the first predetermined linear speed is approximately three inches per second.

16. The motorized roller tube system according to claim 15, wherein the second predetermined linear speed is approximately one inch per second or less.

17. The motorized roller tube system according to claim 13, wherein the motor has a motor torque that is always greater than 50 percent of a maximum torque capability for the motor when the flexible member moves at the second predetermined linear speed.

* * * * *